United States Patent [19]

Konz et al.

[11] 3,950,789

[45] Apr. 20, 1976

[54] DRY ICE COOLING JACKET

[75] Inventors: Stephan A. Konz; Jerry R. Duncan, both of Manhattan, Kans.

[73] Assignee: Kansas State University Research Foundation, Manhattan, Kans.

[22] Filed: July 22, 1975

[21] Appl. No.: 598,079

[52] U.S. Cl. ..... 2/93; 2/97; 2/250; 2/DIG. 6; 62/530; 150/2.4; 150/2.5; 224/5 K

[51] Int. Cl.[2] ..... A41D 1/02

[58] Field of Search ..... 2/69, 81, 93, 94, 108, 2/250, DIG. 1, DIG. 6; 150/2.4, 2.5; 62/530; 219/211; 165/46; 126/204, 205, 206; 224/5 K, 5 N

[56] References Cited

UNITED STATES PATENTS

| | | | |
|---|---|---|---|
| 3,296,819 | 1/1967 | Gough | 2/81 X |
| 3,476,102 | 11/1969 | Sarnoff | 126/204 |
| 3,537,108 | 11/1970 | Daniels | 2/DIG. 6 |
| 3,628,537 | 12/1971 | Berndt et al. | 150/2.4 X |
| 3,643,463 | 2/1972 | Friedlander et al. | 2/81 X |

FOREIGN PATENTS OR APPLICATIONS

| | | | |
|---|---|---|---|
| 499,574 | 11/1954 | Italy | 150/2.5 |
| 1,104,543 | 6/1955 | France | 2/108 |

*Primary Examiner*—Werner H. Schroeder
*Assistant Examiner*—Moshe I. Cohen

[57] ABSTRACT

A cooling jacket provides personal cooling for the wearer by convection as cold carbon dioxide gas circulates within the space between the inside surface of the jacket and the wearer's body. Dry ice is held in pockets inside the jacket, and each pocket is vented to permit the gas to diffuse through the pocket into the space. The bottom of the jacket is provided with a waist band which closes the space at the bottom and restrains the escape of the relatively heavy carbon dioxide gas.

11 Claims, 9 Drawing Figures

DRY ICE COOLING JACKET

GOVERNMENT RIGHTS

The Government has rights in this invention pursuant to Contract No. NSF-75-75-GK-41206 awarded by the National Science Foundation.

BACKGROUND

This invention relates to a personal cooling jacket which utilizes cold carbon dioxide gas to provide convection cooling. Cooling by convection is maximized, while cooling by conduction, although it occurs to some extent, is relatively less important.

There are many situations in which it is desirable to provide cooling to a worker or other person. However, it is often not economical or practical to cool the environment. For example, although it would be desirable to provide cooling to such people as fire fighters and workers in blast furnaces, steel mills, and other hot areas, it is not practical to cool the working environment. In these instances it is advantageous to use personal cooling, i.e., cooling of the individual rather than the environment.

One way of achieving personal cooling is described in the publication entitled "Personal Cooling With Dry Ice," published in the March, 1974 issue of American Industrial Hygiene Association Journal. This publication describes a method of personal cooling by conduction in which blocks of dry ice are held in pockets of a vest. The vest is worn over bare skin, and the cold dry ice cools the wearer by conduction. Insulation is provided between the dry ice and the skin for protection. The publication describes the use of the vest with and without an outer jacket worn over the vest.

Conduction cooling with dry ice is not entirely satisfactory. Such conduction cooling does not provide uniform cooling, and the areas of the body which are directly adjacent the dry ice will be much colder than remote areas. The body tends to counteract excessive cooling, e.g., by causing shivering which will raise the body heat.

SUMMARY

The invention provides cooling by convection rather than by conduction. The dry ice is insulated from the wearer, and the holding pockets are vented so that carbon dioxide gas can diffuse into the space between the jacket and the body. The cold gas is held against the body by the relatively non-porous jacket, which also provides insulation against the outer environment, and the waist band of the jacket prevents the relatively heavy gas from escaping downwardly. The gas diffuses through the space to provide substantially uniform cooling, and an equilibrium is established between gas leaving the pocket and gas which leaves the jacket space either by diffusing slowly through the jacket or by escaping through body openings in the jacket. The jacket can be provided with or without sleeves, and if the jacket has sleeves, normal arm movements create a pumping action which forces gas into the sleeves.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
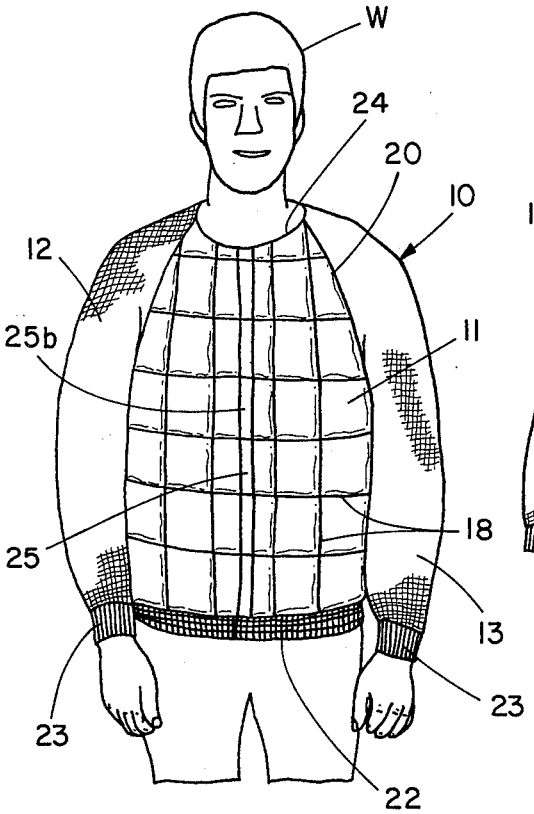
FIG. 1 illustrates a person wearing a cooling jacket formed in accordance with the invention.

Referring to FIGS. 1–4, the numeral 10 designates generally a personal cooling jacket which is worn by a worker W or other person to be cooled. The jacket 10 has a somewhat conventional outer appearance and includes a torso portion 11 and right and left sleeves 12 and 13. The torso portion 11 is generally vest-shaped and includes a quilted nylon outer shell 14 (FIG. 4) and a nylon inner shell or liner 15 which is sewn or otherwise attached to the outer shell. The quilted outer shell includes a pair of nylon sheets 16 and 17 which are sewn together along lines 18 (see also FIG. 1) to form closed pockets or spaces which are filled with insulation 19. The vest-shaped torso portion is provided with arm openings 20 to which the sleeves are attached.

The particular jacket illustrated in waist length, and the bottom of the torso portion is provided with an elastic waist band 22 which holds the bottom of the torso portion snugly around the waist or adjacent portion of the wearer's body. Similarly, each of the sleeves 12 and 13 are provided with an elastic wrist band 23 which holds the end of the sleeve snugly against the arm. Other types of end closures can be used, such as string ties or the like. The neck opening 24 of the jacket illustrated is not provided with an elastic closure, but it will be understood that such a closure can be used if desired.

The front of the jacket is releasably closed by a hook and loop fastener 25 such as is commonly sold under the name VELCRO. One strip 25*a* (FIG. 2) of the hook and loop fastener is secured to one of the front halves of the jacket and the complementary strip 25*b* is secured to the other front half. The hook and loop fastener is desirable because it provides a relatively good seal against the escape of carbon dioxide gas from inside the jacket, but other types of closures can be used.

Figure 2:
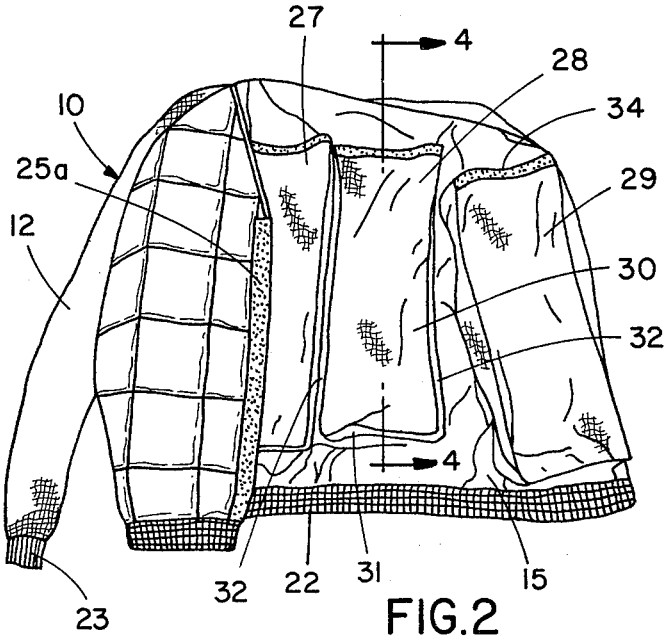
FIG. 2 is a perspective view of the jacket showing both the exterior and interior construction.
Figure 3:
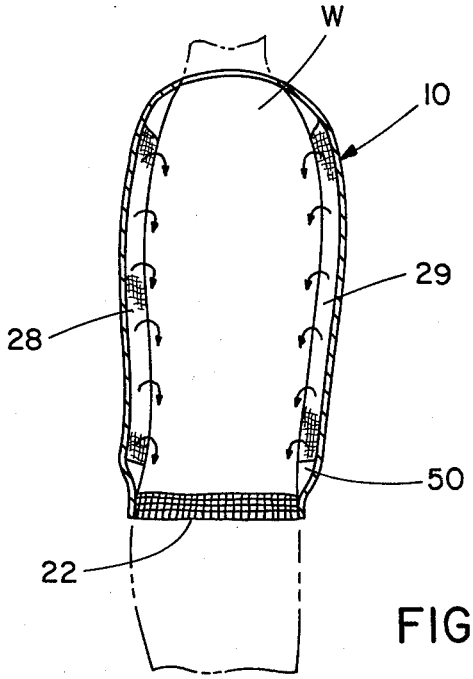
FIG. 3 is a schematic sectional view illustrating the convection cooling provided by the jacket.
Figure 4:
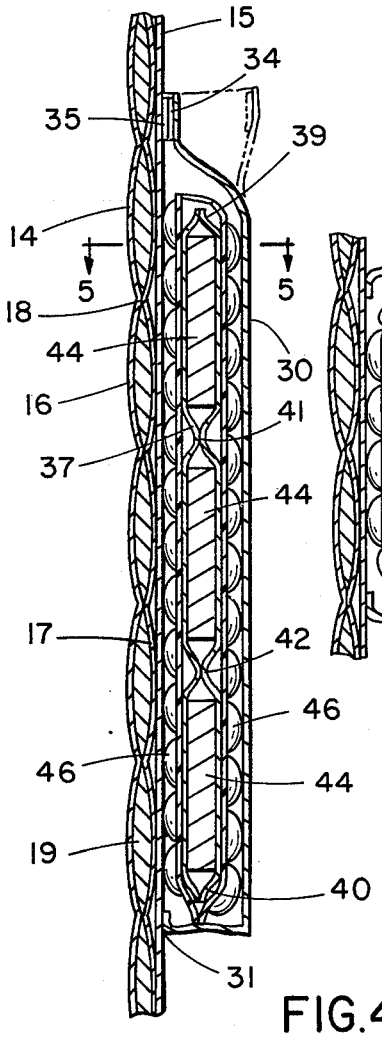
FIG. 4 is an enlarged fragmentary sectional view taken along the line 4—4 of FIG. 2.

Referring now to FIG. 2, the back portion of the jacket is provided with a pair of generally vertically extending elongated pockets 27 and 28, and the left front half of the jacket is provided with a pocket 29. The right half front of the jacket is provided with a similar pocket which is not shown. Each of the pockets is formed from a generally rectangular piece of fabric 30 which is stitched to the inner shell 15 along the bottom edge 31 and the upwardly extending side edges 32. Each pocket is adapted to hold one or more blocks of dry ice, and after the dry ice is inserted, the upper end of the pocket is closed by suitable fastening means. In the embodiment illustrated, the upper end of each pocket is provided with a short strip 34 of a hook and loop fastener which can be removably secured to a complementary strip 35 which is attached to the inner shell 15. The upper end of the pocket in FIG. 4 is illustrated in phantom before the strips are secured to each other.

The dry ice is maintained substantially uniformly along the vertical length of each pocket by a holder 37 (FIG. 6) which is formed from two layers of a mesh or net material. The two layers of mesh have generally the same shape as the rectangular pocket and are stitched together along one of the long sides 38 and along the top and bottom edges 39 and 40. The mesh is also stitched along horizontal lines 41 and 42 to form three ice pockets 43 between the horizontal stitching. Three blocks 44 of dry ice are inserted into the pockets of the holder 37 through the open sides thereof, and the holder is then inserted into an upwardly opened insulating sleeve or pocket 45. The particular insulating sleeve 45 is formed from a sheet of commercially available insulating material which is formed from two laminated layers of plastic film, one of the layers being provided with air bubbles 46. The laminated insulating sheet is folded in half and secured along the bottom edge 47 and side edge 48 to provide a closed insulating sleeve with one open end.

An ice-containing insulating sleeve is inserted into each of the pockets of the jacket, and the upper closure of each pocket is fastened. The jacket is then donned by the wearer, and even though the pockets of the jacket may press directly against the skin of the wearer, the insulation provided by both the insulating sleeve 45 and the pocket fabric will prevent excessive cooling of those portions of the body which contact the pockets. The jacket is desirably fitted somewhat loosely to provide a space (designated 50 in FIG. 3) between the inner shell 15 of the jacket and the wearer's body. However, even if the jacket fits relatively tightly, the pockets, which are filled with dry ice, serve to space the inner shell away from the body to provide the desired space.

Figure 5:
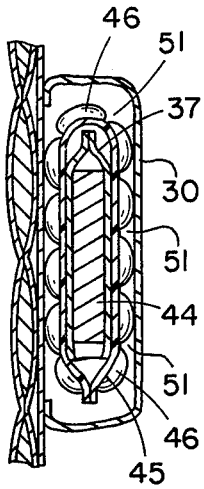
FIG. 5 is a fragmentary sectional view taken along the line 5—5 of FIG. 4.

As the dry ice sublimates, the cold carbon dioxide gas, although heavier than air, is forced to rise upwardly within each pocket by the substantially impervious film of the insulating sleeve 45. The heavy carbon dioxide gas then flows over the open upper end of the insulating sleeve and down the outer side of the sleeve. The air bubbles 46 extend outwardly from the outer layer of the sleeve and space the pocket outwardly from this layer to provide flow channels (FIG. 5) for the carbon dioxide. The pockets are formed from porous material such as woven cotton, loose-knit nylon, etc. which readily permits the carbon dioxide gas to diffuse to permeate through the pocket. Accordingly, as the carbon dioxide gas flows downwardly between the insulating sleeve and the pocket, gas will diffuse through the pocket along the entire length thereof as illustrated by the arrows in FIG. 3. The gas substantially uniformly fills the jacket space 50 between the inner surface of the jacket and the body and provides uniform cooling to that portion of the body which is covered by the jacket. Although some conduction cooling might be provided by the dry ice through the insulation, most of the cooling is provided by convection, and localized excessive cooling is prevented.

The inside surfaces of the sleeves are also spaced from the arms of the wearer, and the carbon dioxide gas will diffuse from the torso portion of the jacket into the sleeves. This diffusion will be facilitated by normal arm movements of the wearer, which provide a pumping effect to force carbon dioxide into the sleeves. Escape of carbon dioxide gas from the sleeves is substantially prevented by the elastic wrist bands 23.

The outer sheet 16 of the jacket is preferably relatively non-porous to maintain the carbon dioxide gas within the jacket space and to limit diffusion of the gas through the jacket to the outer environment. However, some carbon dioxide gas will diffuse through the material of the jacket, and some gas will escape past the elastic bands 22 and 23. However, the rate of escape of carbon dioxide gas from the jacket space is preferably maintained at a level no greater than the rate of diffusion of the carbon dioxide gas from the pockets so that an equilibrium level is reached and the cooling is maintained substantially constant.

The neck opening 24 of the jacket illustrated in FIG. 1 is not closed by an elastic band or equivalent closure means. Since the carbon dioxide gas is heavier than air, very little carbon dioxide will escape through the neck opening, and the amount of any carbon dioxide which may reach the face of the wearer is well within safe limits. If desired, however, a neck closure can be used to restrain the escape of carbon dioxide from the neck opening.

Figure 7:
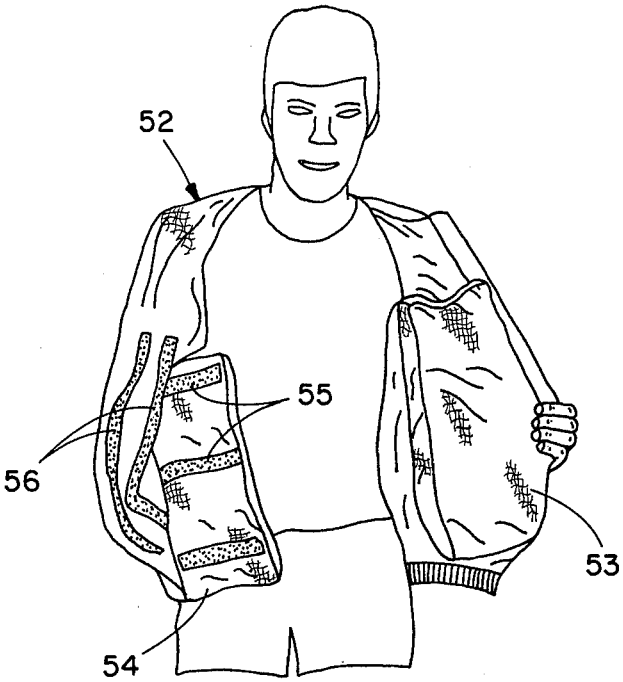
FIG. 7 illustrates a modified form of cooling jacket in which the dry ice pockets are removable.

FIG. 7 illustrates a cooling jacket 52 which is identical to the cooling jacket 10 except that it is equipped with removable dry ice pockets 53 and 54. Each of the pockets is closed except at the top, and strips 55 of hook and loop fastening material are secured to the back of the pocket for attachment to complementary strips 56 attached to the inside of the jacket. The pocket strips 55 extend horizontally, and the jacket strips 56 extend vertically so that the vertical position of the pockets can be adjusted as desired. The jacket also includes rear pockets which are similarly removably secured to the inside of the back of the jacket.

Figure 8:
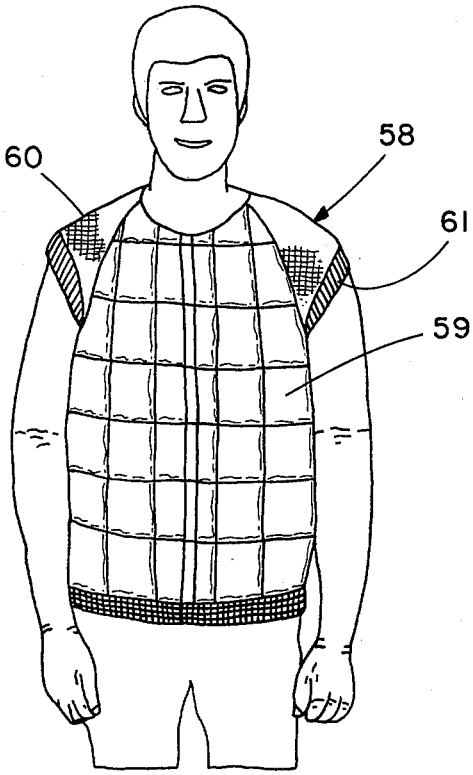
FIG. 8 illustrates a sleeveless cooling jacket.

FIG. 8 illustrates a jacket 58 identical to the jacket 10 except that it is sleeveless. The jacket 58 includes a vest-shaped torso portion 59 identical to the torso portion 11, and shoulder portions 60 which are connected to the arm openings of the torso portion and cover the shoulders. The shoulder portions are provided with elastic bands 61 to restrain the escape of carbon dioxide gas from the inside of the jacket.

Figure 6:
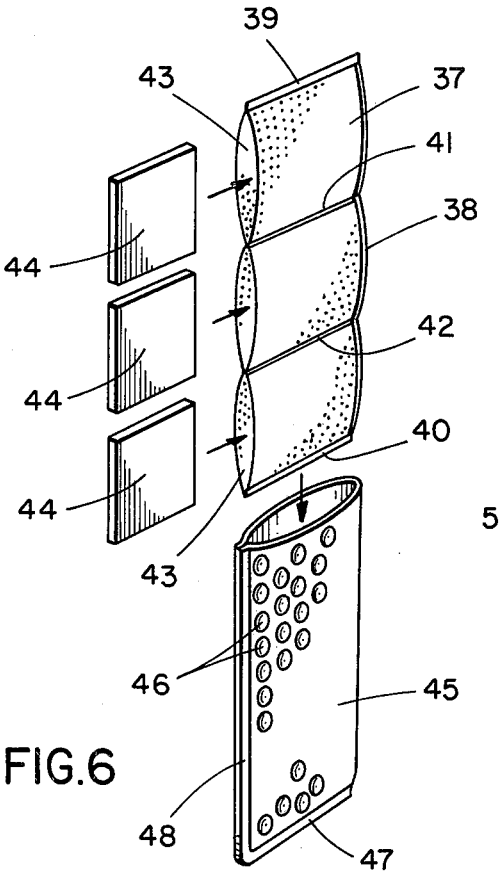
FIG. 6 is an exploded perspective view showing the dry ice, ice holder, and insulation.

The insulating sleeve 45 illustrated in FIGS. 4 and 6 is formed of substantially non-porous material so that the carbon dioxide will be channeled upwardly to the top of the pocket and then diffuse through the pocket throughout its entire length. However, since the ice holder 37 spaces the dry ice along the length of the pocket, carbon dioxide gas will diffuse through the upper portion of the pocket even if the insulating sleeve were porous or even eliminated. Also, although we have found that the air bubbles 46 serve as excellent spacer means for providing flow channels, other spacer means can be used to facilitate flow of carbon dioxide between the dry ice and the pocket fabric.

Figure 9:
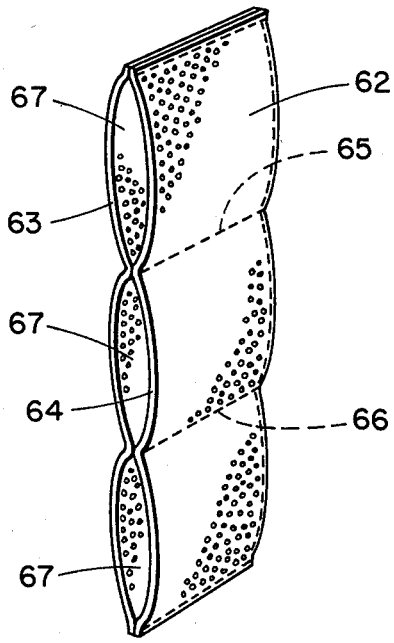
FIG. 9 illustrates another form of insulating sleeve for the dry ice.

A combination holder and insulator 62 is illustrated in FIG. 9. The insulator is formed from a pair of sheets 63 and 64 of porous insulating material such as porous polyurethane foam, and the sheets are suitably secured together, as by stitching, along the top, bottom, and one side edge, and along two horizontal lines 65 and 66 to form three dry ice pockets 67. When the insulator is filled with dry ice and inserted into the pocket, carbon dioxide gas will diffuse through each of the pockets of the insulator and through the porous pocket into the jacket space. The thickness of the insulating sheets is selected to provide sufficient insulation to prevent excessive localized conduction cooling and may be of the order of about ¼ inch to ⅜ inch.

Since the pockets of the insulator are provided with open ends, carbon dioxide gas will diffuse from the open ends even if the insulating material is non-porous.

It will be apparent from the foregoing description that the number, location, and size of the pockets can be varied. For example, two vertically spaced pockets can be used in place of one elongated pocket. However, providing a plurality of vertically spaced pockets not only provides more uniform diffusion of carbon dioxide along the length of the jacket but more evenly distributes the weight of the dry ice.

In the embodiments illustrated the vent means in the pockets for permitting the carbon dioxide to diffuse through the pockets were provided by the pores or openings, i.e., the porosity, of the fabric. It will be understood, however, that other vent means can be used. For example, the material of the pocket can be provided with a plurality of perforations. If sufficient perforations are provided to ensure substantially uniform diffusion, the pocket material can even be made of non-porous material.

While in the foregoing specification detailed descriptions of specific embodiments of the invention were set forth for the purpose of illustration, it is to be understood that many of the details herein given may be varied considerably by those skilled in the art without departing from the spirit and scope of the invention.

We claim:

1. A garment for cooling the body of a person wearing the garment, the garment having an inner surface which faces the body of the person when the garment is worn and which defines a space between the garment and a portion of the body, a pocket on the inner surface of the garment for holding dry ice, the pocket being provided with means for venting gaseous carbon dioxide through the pocket to said space as the dry ice sublimates whereby gaseous carbon dioxide in said space cools the body by convection.

2. The garment of claim 1 in which the venting means is provided by openings in the pocket.

3. The garment of claim 1 in which the venting means is provided by openings throughout substantially the entire surface of the pocket.

4. The garment of claim 1 including insulation between the dry ice and the body of the wearer.

5. The garment of claim 1 in which the garment is adapted to be worn on the upper body of the person wearing the garment and includes means for tightening the garment around the waist of the person.

6. The garment of claim 5 in which the tightening means comprises an elastic band.

7. The garment of claim 1 in which the garment is a jacket and includes sleeves for covering the arms of the wearer, each of the sleeves having an inner surface which defines a space between the sleeve and the associated arm of the wearer whereby gaseous carbon dioxide can cool the arms by convection.

8. The garment of claim 1 in which the pocket is removably attached to the inner surface of the garment.

9. The garment of claim 1 includng means in the pocket for channeling carbon dioxide gas within the pocket to an upper portion of the pocket and spacer means between the dry ice and the pocket to provide gas flow channels to permit the carbon dioxide gas to flow downwardly adjacent the pocket.

10. The garment of claim 9 in which the channeling means comprises a substantially gas-impervious sleeve into which the dry ice is inserted.

11. A jacket for cooling the upper body of a person wearing the jacket, the jacket having a front and a back and an inner surface which faces the body of the person when the jacket is worn and which defines a space between the jacket and the upper body, at least one pocket on the inner surface of the front of the jacket and at least one pocket on the inner surface of the back of the jacket, each of the pockets being adapted to hold dry ice and having means for venting gaseous carbon dioxide from the pocket into said space as the dry ice sublimates whereby gaseous carbon dioxide in said space cools the body by convection, means for channeling gaseous carbon dioxide upwardly within each pocket, and spacer means between the channeling means and each pocket to provide gas flow channels to permit carbon dioxide gas to flow downwardly between the channeling means and the pocket, the jacket having a lower end provided with means for tightening the jacket around the waist of the person whereby leakage of gaseous carbon dioxide from said space around the lower end of the jacket is substantially prevented.

* * * * *